US005368540A

United States Patent [19]

Saab

[11] Patent Number: 5,368,540

[45] Date of Patent: Nov. 29, 1994

[54] HYPOCYCLOIDAL FOLDING DEVICE

[75] Inventor: Saeed Saab, Oise, France

[73] Assignee: Heidelberger Druckmaschinen AG, Heidelberg, Germany

[21] Appl. No.: 32,906

[22] Filed: Mar. 18, 1993

[30] Foreign Application Priority Data

Mar. 18, 1992 [FR] France ..... 92 03222

[51] Int. Cl.[5] ..... B65H 45/16

[52] U.S. Cl. ..... 493/424; 493/444

[58] Field of Search ..... 493/424–433, 493/437, 444, 445, 457

[56] References Cited

U.S. PATENT DOCUMENTS 5,169,376 12/1992 Ries ..... 493/445
5,284,466 2/1994 Magnusson ..... 493/431

FOREIGN PATENT DOCUMENTS 2407576 8/1975 Germany ..... B41F 13/70
1494851 12/1977 Germany ..... B65H 29/68
1494852 12/1977 Germany ..... B65H 29/68
12643 2/1981 Germany .

*Primary Examiner*—Jack Lavinder
*Attorney, Agent, or Firm*—Kenyon & Kenyon

[57] ABSTRACT

A folding device for folding a copy along a line parallel to a direction of forward travel of the copy, the copy being delivered to a folding table having a longitudinal central slit, is disclosed. The folding device includes a crankshaft, disposed below the folding table in line with the central slit, which is rotatably driven about a central axis of rotation parallel to the direction of forward travel of the copy. The folding device also includes a folding cylinder having a radius R and an external surface S, which is rotatably mounted about a central geometric axis on the crankshaft. The central geometric axis is parallel to the central axis of rotation of the crankshaft and offset with respect to the central axis of rotation by a distance equal to the radius R. Each time a copy is folded, the crankshaft makes a complete revolution about the central axis of rotation simultaneously driving the folding cylinder through its own rotational movement about the central geometric axis, so that any point on the external surface S of the folding cylinder moves along a straight line of length equal to four times the radius R.

10 Claims, 4 Drawing Sheets

HYPOCYCLOIDAL FOLDING DEVICE

FIELD OF THE INVENTION

The present invention relates generally to a folding device for folding a copy along a line parallel to the direction of forward travel of the copy, and more particularly, to a quarter fold device used in rotary printing.

BACKGROUND OF THE INVENTION

Devices are known for printing webs of paper in which the machines for printing webs of paper are generally fed by a spool of paper mounted on an unwinder and from which the web of paper is drawn with the aid of a dispenser. The printing of such a web of paper is carried out by passing this web through one or more printing units then through a hot air drier and through a set of cooling rollers in order to fix the film of ink on the web of paper. Subsequently, the printed web of paper is folded at its middle along a longitudinal direction by a folding device commonly known to a person of ordinary skill in the art as a kite. The longitudinally folded web of paper is cut up into copies between two cylinders, a transfer cylinder and a cutting cylinder.

A first transverse folding of the copies is carried out between the transfer cylinder equipped with engaging blades and a folding cylinder equipped with jaws. The copies coming from the folding cylinder folded perpendicularly to their direction of forward travel, are held and transported by two sets of belts situated respectively above and below the copies.

In order to fold a folded copy for a second time, along a fold perpendicular to the first fold produced, a longitudinal folding device called a quarter fold is used which forms a fold parallel to the direction of forward travel of the copy. In this case, the copies are transported by the belts as far as the quarter fold on a longitudinal folding table comprising a longitudinal slit.

The quarter fold device includes an engagement blade of known type placed above the longitudinal slit and moving alternately upwards and downwards in order to introduce the paper copy into the slit. It also includes, below the longitudinal slit, two folding rollers whose geometric axes of rotation are parallel to the slit. These two rollers rotate in opposite directions so as to create a drawing-in space between them. A copy engaged in the slit is drawn into the space and folded between the two rollers, then leaving the rollers at a speed equal to the superficial rotational speed of the rollers.

A device known as a fan, well known to a person of ordinary skill in the art, receives the folded copies leaving the rollers. The fan slows down the copies and places them one after the other on a receiving belt moving slowly so that the copies partially overlap one another forming a sheet.

These conventional quarter folding devices, however, exhibit certain drawbacks. For one, when a copy is engaged in the slit by the engagement blade, it is drawn in abruptly at the speed of the folding rollers. In the case of a thin paper copy, the contact between the rollers and the paper is insufficient, and for this reason the copy slides on the surface of the rollers.

Another drawback with the prior art devices is that upon leaving the folding rollers, a copy retains the speed of the rollers and must be slowed down in the fan or like device. During the transfer of the copy from the quarter fold to the fan, the copy may tear and/or become wedged.

OBJECTS AND SUMMARY OF THE INVENTION

It is an object of the present invention to provide a folding device for folding a copy along a line parallel to the direction of forward travel of the copy which is capable of firmly gripping the copy regardless of its thickness.

It is an object of the present invention to provide a folding device for folding a copy along a line parallel to the direction of forward travel of the copy which does not tear or wedge the copies.

A further object of the present invention is to provide a folding device capable of folding an already-folded copy along a line perpendicular to the first fold, making it possible to grasp the copy to be folded at zero speed through the slit of the folding table and also to deposit the folded copy at zero speed on the receiving belt.

The present invention provides a folding device for folding a copy along a line parallel to a direction of forward travel of the copy, the copy being delivered to a folding table having a longitudinal central slit, comprising: a crankshaft, disposed below the folding table in line with the central slit, rotatably driven about a central axis of rotation parallel to the direction of forward travel of the copy; and a folding cylinder having a radius R and an external surface S, rotatably mounted about a central geometric axis on the crankshaft, the central geometric axis being parallel to the central axis of rotation of the crankshaft and offset with respect to the central axis of rotation by a distance equal to the radius R, so that each time a copy is folded, the crankshaft makes a complete revolution about the central axis of rotation simultaneously driving the folding cylinder through its own rotational movement about the central geometric axis, so that any point on the external surface S of the folding cylinder moves along a straight line of length equal to four times the radius R.

Thus, according to the present invention, each time a copy is folded, the folding cylinder revolves about its central geometric axis at a constant speed while rolling without sliding inside a circle C traveled by the crankshaft rotating about its central axis of rotation. In this way, any point on the external surface S of the folding cylinder travels along a hypocycloid path contained within the circle C. Moreover, the circle C traveled by the crankshaft is fixed relative to the folding table and has a radius equal to the diameter of the folding cylinder. Consequently, the hypocycloid paths traveled by the points on the external surface S of the folding cylinder are diameters of the circle C, that is to say straight lines passing through the center of the circle C and of length equal to four times the radius R.

In particular, a folding jaw on the folding cylinder 1 situated on a generatrix of the surface S, travels along, upon each folding, this straight line of length 4R between a position for gripping the copy through the slit of the folding table and a position for releasing the copy onto the receiving belt, the gripping and freeing positions corresponding to points brushing up against this particular hypocycloid path, where the speed of the folding jaw is zero with respect to the fixed circle and more precisely with respect to the folding table. In this way, the device according to the present invention makes it possible to grasp a copy to be folded at zero speed, and to deposit it in the folded state also at zero speed.

The present invention also provides a folding device which comprises a folding blade placed in line with the slit just above the copy to be folded placed in a gripping position on the folding table, and extending in a horizontal direction parallel to the direction of forward travel of the copy, the blade oscillating vertically in synchronization with the rotational movements of the crankshaft and folding cylinder, so that the blade engages in the folding jaw when the folding jaw is below the gripping position.

Thus, according to the present invention, the folding blade is a blade for engaging the copy to be folded in the folding jaw of the folding cylinder. The vertical oscillating movement of the folding blade is of the epicycloid type coordinated with the rotational movement of the device according to the present invention and more particularly with the movement, of hypocycloid type, of the folding jaw.

The present invention further provides that the folding blade for engaging the copy to be folded may be fixed and upon each passage of the folding jaw in line with the slit, an active portion of the folding jaw projects through the slit in order to grip the copy to be folded, which is positioned on the slit.

Other objects, characteristics and advantages of the present invention will become apparent in view of the following detailed description and accompanying drawings.

DETAILED DESCRIPTION

Figure 1:
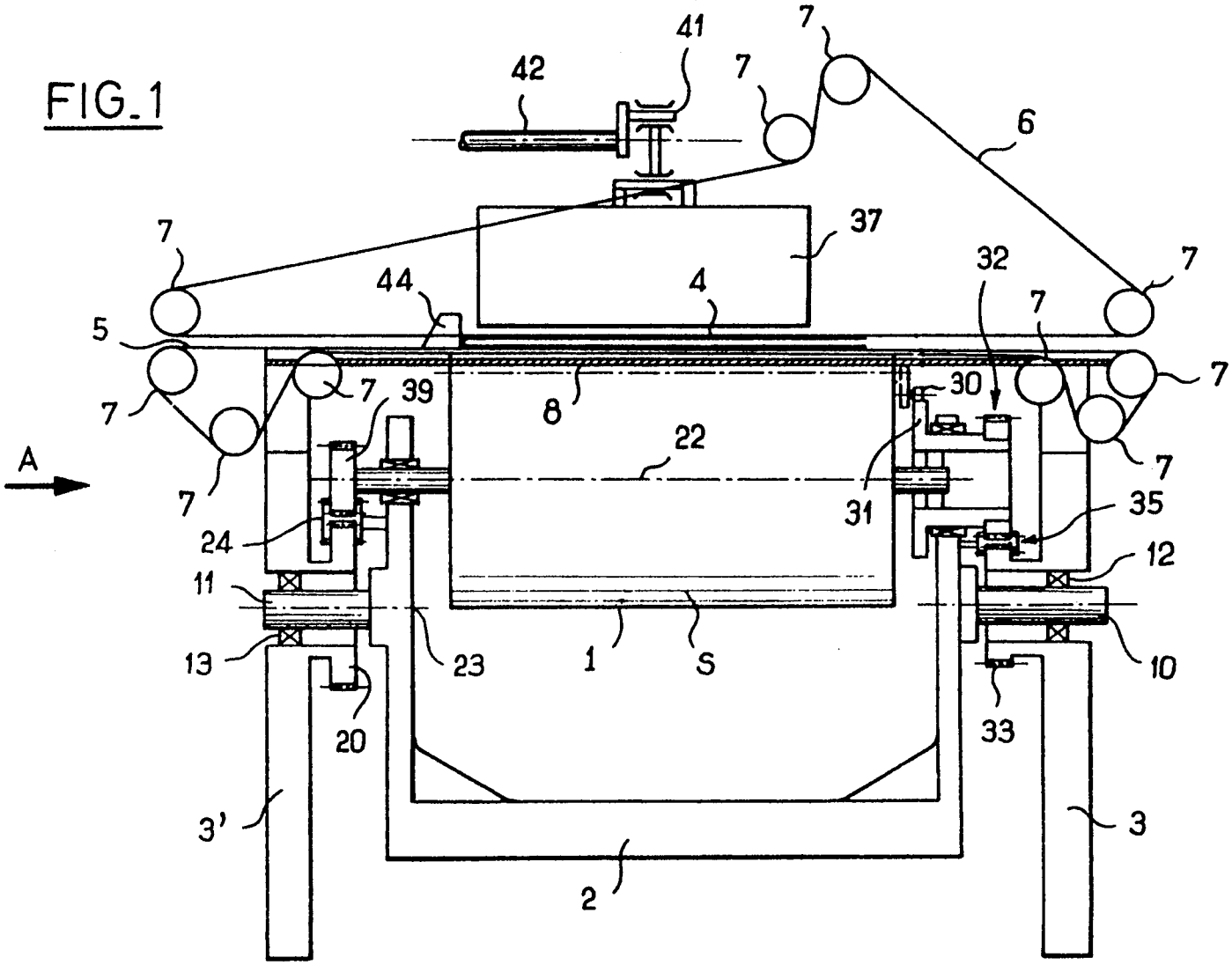
FIG. 1 is an overall view of a folding device according to the present invention.
Figure 2:
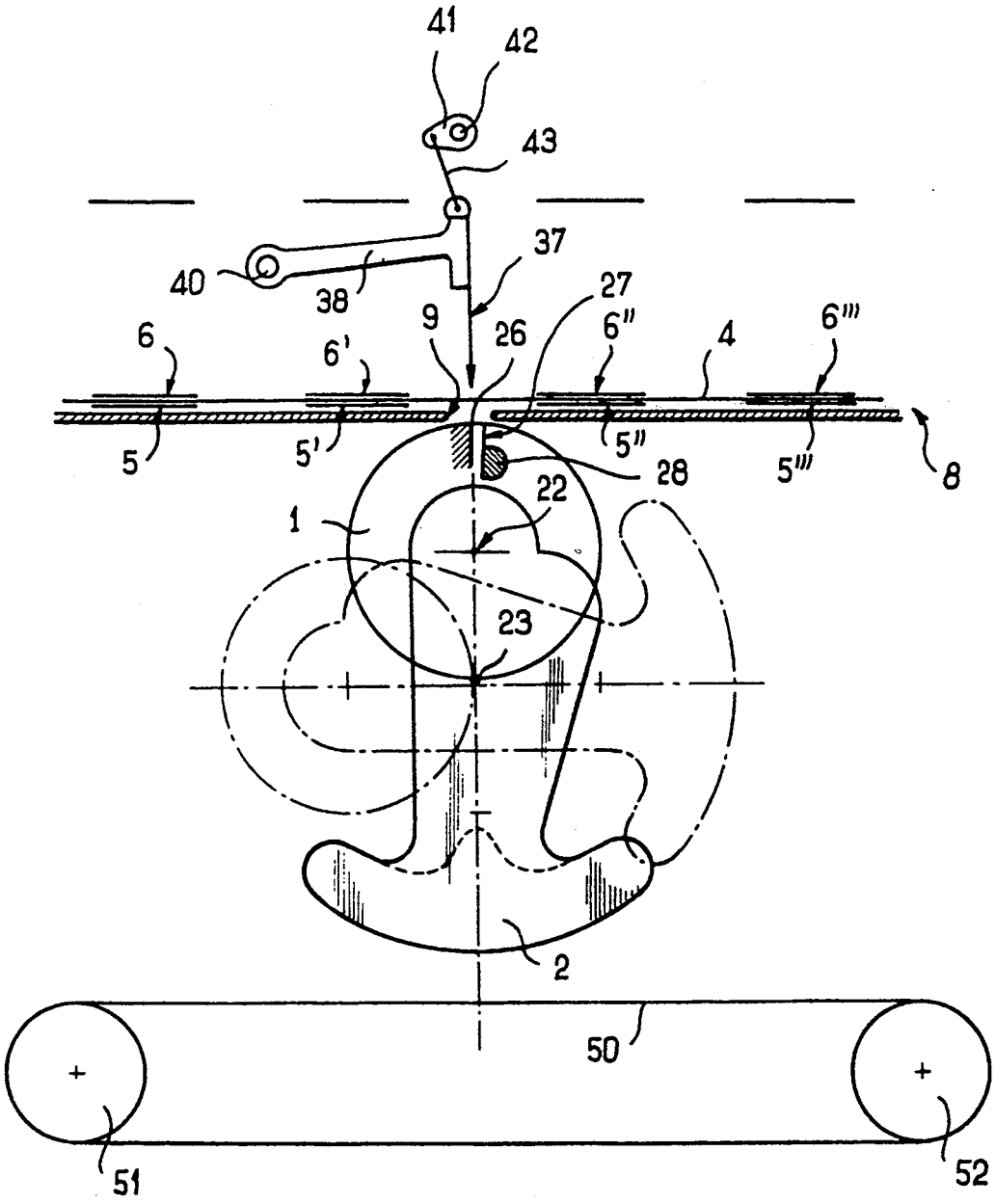
FIG. 2 is a lateral view in the direction A of the device of FIG. 1.
Figure 3:
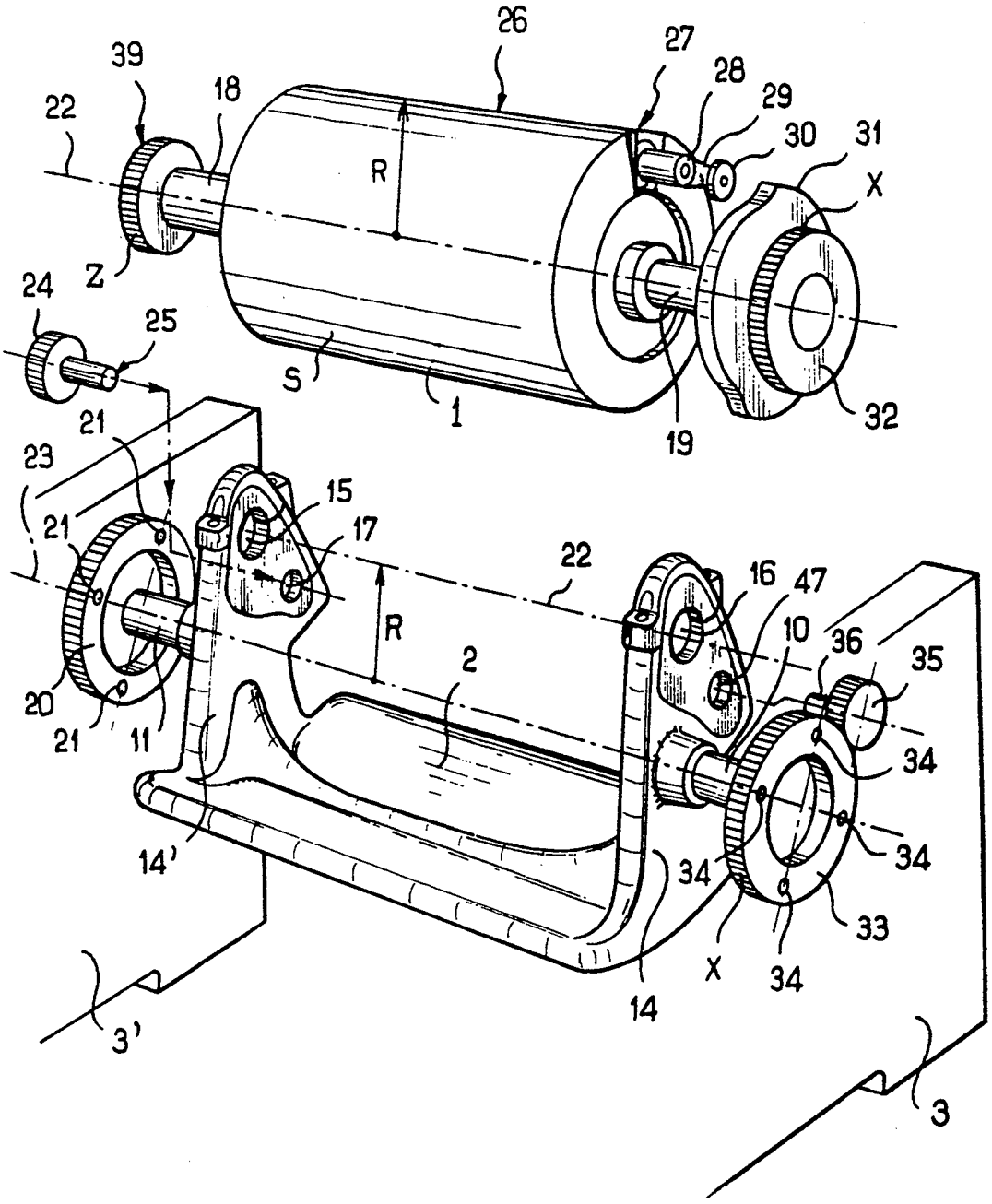
FIG. 3 is a perspective view of the crankshaft and of the folding cylinder of the folding device of FIG. 1.

With reference to FIGS. 1, 2 and 3, a folding device according to the present invention is shown capable of folding a copy 4 along a line parallel to a direction of forward travel of the copy 4.

As can be seen in FIGS. 1 and 2, each copy 4 to be folded is already folded in two by a first folding apparatus, not shown, and transported out of the first folding apparatus, as far as a folding table 8 equipped with a longitudinal slit 9 in its central part, by two sets of drive belts 5, 5', 5'', 5''' and 6, 6', 6', 6''' placed respectively below and above the copy. These belts 5, 5', 5, 5''' and 6, 6', 6'', 6''' are endless belts and are driven by a set of rollers 7 only one of which is driven at the rotational speed of the press, the other rollers being mounted to rotate freely.

Each copy 4 to be folded is stopped in its forward travel by a stop 44 provided on the folding table 8 so as to be correctly positioned over the slit 9 and ready to be folded by means of the device according to the present invention.

As better shown in FIGS. 1 and 3, the folding device according to the present invention comprises a crankshaft 2 placed just below the folding table 8 in line with the longitudinal slit 9 and rotationally mounted between two frameworks 3, 3' fixed opposite each other. More precisely, the crankshaft 2 is driven in a rotational movement about a central axis of rotation 23 by two opposing journals 10, 11 mounted on each of the sides 14, 14' of the crankshaft 2, concentric to the axis 23 and respectively engaged in two bearings 12, 13 of the framework 3, 3' fixed opposite each other. The journal 10 is connected to a general drive device, not shown, so as to rotatably drive the crankshaft 2.

Furthermore, the device shown in FIGS. 1 and 3 comprises a folding cylinder 1 having a radius R and an external surface S. This folding cylinder 1 is rotatably mounted about its central geometric axis 22 on the crankshaft 2 by means of two other opposing journals 18, 19, placed at each end of the folding cylinder concentric with the central geometric axis 22, and respectively engaged in two opposite bearings 15, 16 provided on each side 14, 14' of the crankshaft 2. The two bearings 15, 16 are respectively placed at a distance equal to R from the two journals 10, 11 so that the central geometric axis 22 of the cylinder 1 and the central axis of rotation 23 of the crankshaft 2 are parallel and offset by a distance equal to the radius R. In addition, it should be noted that the two axes 22, 23 are parallel to the direction of forward travel of the copies to be folded.

More particularly, the folding cylinder 1 comprises, on its left-hand side a first rotational drive means consisting here of a first pinion 39 keyed onto the journal 18 and comprising Z meshing teeth, as shown in FIG. 3. This first pinion 39 interacts with a second intermediate drive means, here an intermediate pinion 24 mounted on a journal 25 engaged in a bearing 17 provided on the corresponding left-hand side 14' of the crankshaft 2. Moreover, the second intermediate pinion 24 is positioned on the crankshaft 2 in such a manner that it interacts with a third drive means such as a third pinion 20 mounted by means of screws 21 on the fixed framework 3', concentric to the journal 11 of the crankshaft 2. The third pinion 20 comprises a number of meshing teeth equal to twice the number Z of the meshing teeth of the pinion 39. The set of drive means, pinions 39, 24, 20, is therefore intended to drive the folding cylinder 1 in its own rotational movement about its central geometric axis 22 when the crankshaft 2 revolves about the central axis of rotation 23.

Each time a copy 4 is folded, the crankshaft 2 carries out a complete revolution about the central axis of rotation 23, simultaneously driving, by means of the set of pinions 39, 24, 20, the folding cylinder 1 in its own rotational movement about its central geometric axis 22, such that any point on its external surface S moves along a straight line of length equal to four times the radius R of the folding cylinder. The coordinated rotational movements of the crankshaft 2 and of the folding cylinder 1 will be described in detail in the description of FIGS. 4*a–d*.

The folding cylinder 1 comprises a folding jaw 26, 27 mounted radially on the surface S of the folding cylinder and extending along a generatrix of the surface S, as shown in FIGS. 2 and 3. The folding jaw 26, 27 is intended to form a fold in the copy 4 arriving on the folding table 8, along a direction parallel to the direction of forward travel of the copy 4. The folding jaw 26, 27 includes an elastic gripping blade 27 interacting with an edge 26 of the folding cylinder 1, cut out along a generatrix of its surface S. Each opening and closing of the folding jaw 26, 27 is controlled by a set of control elements 28, 29, 30, 31, 32 mounted on the folding cylinder 1 and connected to a member 35, 33 for transmitting the rotational movement of the crankshaft 2, as shown in FIG. 3. Thus, upon each passage of the folding cylinder 1 just below the slit 9, the folding jaw 26, 27 is placed in line with the slit 9 and grips a copy to be folded introduced into the slit, then releases the folded copy onto a receiving belt 50 placed below the assembly comprising the crankshaft 2 and the folding cylinder.

More particularly, the set of control elements mounted on the folding cylinder 1 includes a shaft 28 connected to the elastic gripping blade 27 of the jaw 26, 27 and parallel to the central geometric axis 22 of the folding cylinder. The shaft 28 is connected by keying to one end of a lever 29, the other end of the lever itself is fixed to a cam follower 30. The set of control elements further comprise a cam 31 rotatably mounted concentric to the journal 19 of the folding cylinder 1, opposite the pinion 39. The cam 31 is connected to the transmission member 35, 33 by means of a first drive member 32, preferably a first pinion 32 fixed to the cam 31. The cam follower 30 moves pressing on the cam 31 and the movement of the cam 31 makes it possible to actuate the cam follower 30 in order to close and to open the folding jaw 26, 27 as a function of the rotations of the crankshaft 2 and of the folding cylinder 1. When the cam follower 30 is bearing on a part of the cam 31 of smaller radius, the folding jaw 26, 27 is open. In contrast, when the cam follower 30 is bearing on the part of the cam 31 of larger radius, the folding jaw 26, 27 is closed.

The transmission member 35, 33 includes an intermediate drive member 35, preferably an intermediate pinion 35 mounted on a journal 36 which is rotatably mounted in a bearing 47 provided on the corresponding right-hand side 14 of the crankshaft 2. The transmission member 35, 33 also includes a second drive member 33, preferably a second pinion 33 fixed by means of screws 34 to the framework 3, concentric to the journal 10 of the crankshaft 2. The intermediate pinion 35 interacts with the first and second pinions 32, 33 so as to connect the cam 31 to the rotational movement of the crankshaft 2. The two pinions 32, 33 have the same number of meshing teeth X.

Thus, the gearing comprising the three aforementioned pinions 32, 35, 33 makes it possible to rotatably drive the cam 31, such that the cam follower 30 bears on a part of smaller radius of the cam 31 when the jaw 26, 27 is in line with the slit 9 in order to receive the copy to be folded, then moves onto a part of larger radius of the cam 31, thus closing the jaw during a half-revolution of the crankshaft 2 about the central axis of rotation 23, and is again positioned on a part of smaller radius of the cam 31 when the jaw is above the receiving belt 50 in order to deposit the folded copy thereon.

The folding device according to the present invention further comprises a blade 37 placed just above the folding table 8 in line with the slit 9, so as to be positioned just above the copy 4 in a gripping position, as shown in FIGS. 1 and 2. The blade 37 extends in a horizontal direction parallel to the direction of forward travel of the copy, over the entire length of the slit 9, as shown in FIG. 1. The blade 37 is fixed to a pivoting support 38 which can pivot about a spindle 40 fixed relative to the framework 3, 3', as shown in FIG. 2. A crank pin 41 connected to the general drive device so as to carry out one revolution per copy and keyed to a shaft 42, is connected to the support 38 by means of a connecting rod 43. The crank pin 41 thus makes it possible to impart a vertical oscillating movement of small amplitude to the blade 37, which movement is synchronized with the rotational movements of the crankshaft 2 and of the folding cylinder 1, so that the blade 37 engages in the folding jaw 26, 27 when the folding jaw arrives below the slit 9 in the gripping position. In this manner, the blade 37 makes it possible to introduce each copy 4 to be folded into the folding jaw 26, 27 so as to be folded.

In another embodiment of the present invention, the blade 37 is fixed relative to the framework 3, 3', situated just above the folding table 8, not touching the copy 4 moving towards the stop 44, and the slit 9 is wide enough so that upon each passage of the folding jaw 26, 27 in line with the slit 9, an active portion of the jaw projects through the slit so as to grip the copy 4 to be folded locked by the stop 44 in the folding position on the slit.

With reference to FIGS. 4*a–d*, four phases of an operational half-cycle of the folding device according to the present invention are shown. The crankshaft 2 carries out one complete revolution about the central axis of rotation 23 per cycle, that is to say for each copy 4 to be folded in the direction of the arrow A, the crankshaft rotates through a circle C of diameter equal to four times the radius R of the folding cylinder 1.

Figure 4A:
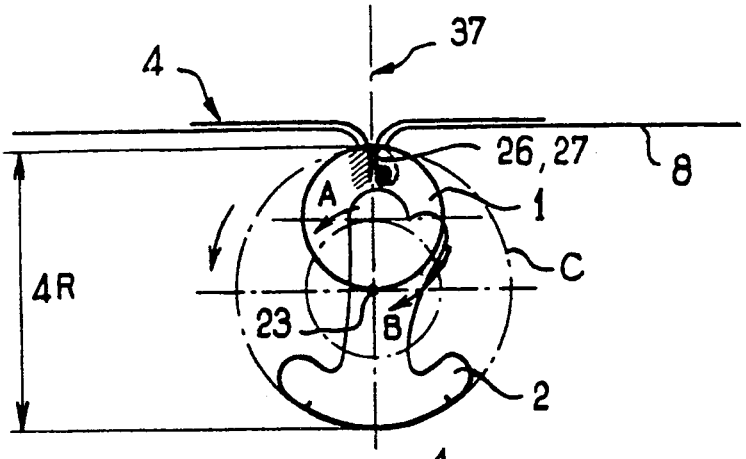
FIGS. 4*a–d* are phase diagrams of an operational half-cycle of the folding device of FIG. 1.

In the first phase of the half-cycle, the folding cylinder 1 is in the gripping position of the copy 4 to be folded, as shown in FIG. 4*a*. During this phase, the folding jaw 26, 27 positioned just below the slit 9, and in line with the slit, grips, at zero speed, the copy 4 introduced by the blade 37.

Figure 4B:
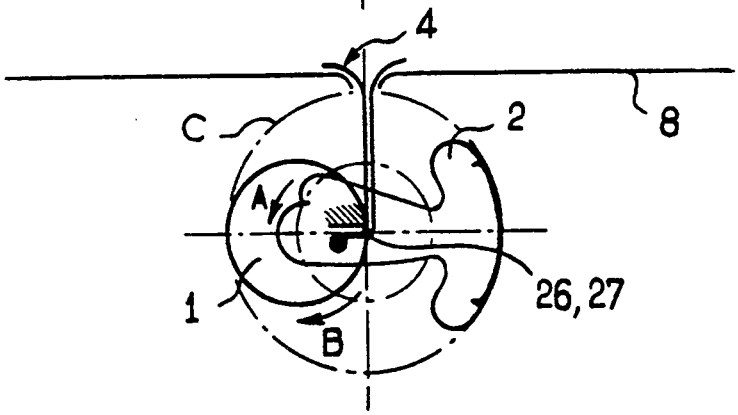

During the second phase, the crankshaft 2 travels through a quarter of a revolution about the central axis 23, rotatably driving the folding cylinder 1 at a constant speed about its central geometric axis 22, so that the folding cylinder 1 rolls without sliding inside the circle C in the direction of the arrow B, as shown in FIG. 4*b*. The diameter of the folding cylinder 1 is preferably equal to the radius of the circle C traveled by the crankshaft 2 during a complete revolution. As a result, the folding jaw 26, 27 situated at the surface of the folding cylinder 1, travels through a first portion of a straight line equal to the radius 2R of the circle C. During this phase, the jaw 26, 27 is closed grasping the copy 4 by its fold.

Figure 4C:
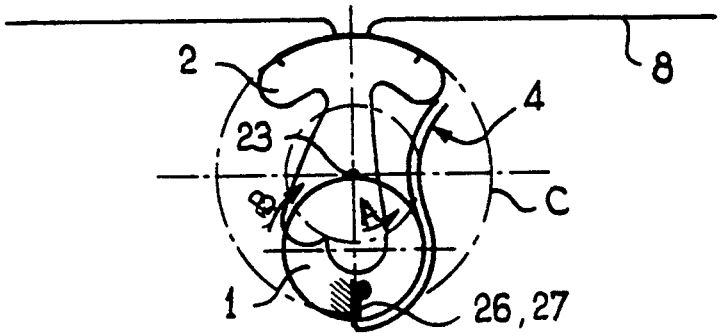

During the third phase, the crankshaft 2 travels through another quarter of a revolution about the axis 23, continuing to rotatably drive the folding cylinder 1 without sliding inside the circle C, as shown in FIG. 4*c*. The closed folding jaw 26, 27 then travels through a second portion of a straight line equal to the radius 2R of the circle C. Once it has arrived in the freeing position above the receiving belt 50, the folding jaw 26, 27 stops and opens releasing the folded copy 4.

Figure 4D:
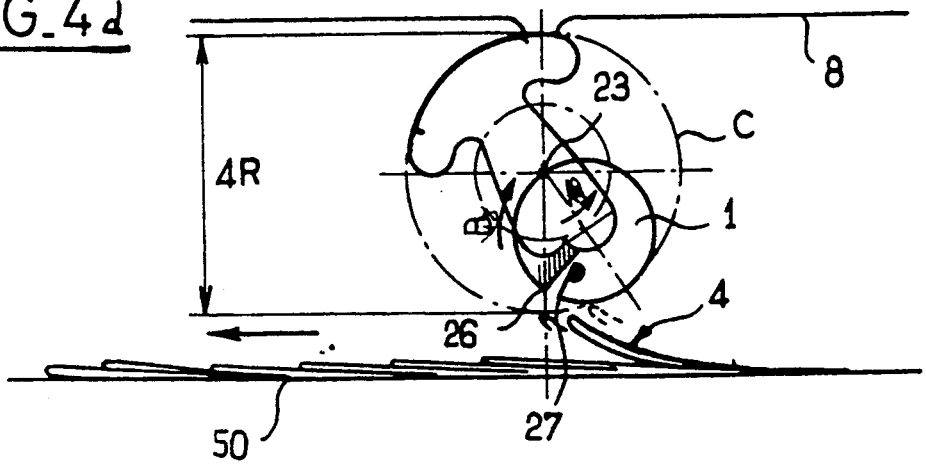

During the fourth phase, the crankshaft 2 continues to revolve through the circle C and rotatably drive the folding cylinder 1; the open folding jaw 26, 27 having released the folded copy 4 depositing it on the receiving belt 50 partially overlapping the preceding copy, as shown in FIG. 4*d*.

For each copy, the crankshaft 2 makes a complete revolution about the central axis 23 traveling along a circle C fixed with respect to the folding table 8 and the receiving belt 50. The circle C has a radius equal to the diameter of the folding cylinder 1. During its movement, the crankshaft 2 rotatably drives the folding cylinder 1 at a constant speed about its geometric central axis 22, so that the folding cylinder rolls without sliding inside the circle C. As a result, any point on the external surface S of the folding cylinder 1 travels along a hypocycloid path inside the circle C. It should be noted that each hypocycloid path comprises brushing-up points, corresponding to the points of contact with the circle C. It follows therefrom that each point on the external surface S of the folding cylinder 1 has its own speed with respect to the circle C, which varies over the corresponding hypocycloid path and cancels itself out at the brushing-up points. In the embodiment illustrated, the hypocycloid paths are straight lines of length 4R, and more precisely diameters of the circle C comprising two brushing-up points at each end.

In particular, the folding jaw 26, 27, being on a generatrix of the surface S of the cylinder 1, travels along a straight line of length 4R between the gripping position and the freeing position of the copy 4, these two positions corresponding to the two brushing-up points of the straight line. The jaw 26, 27's own speed relative to the fixed circle C, canceling itself out at the brushing-up points, also has a zero value with respect to the folding table 8 and to the receiving belt 50.

As a result, the folding device according to the present invention grasps a copy to be folded at zero speed and releases it at zero speed. The present invention, therefore, has an advantage over the folding devices of the "fly" type which often tear copies to be folded as a result of having to slow down these copies.

The present invention is capable of various modifications and alternate constructions. For example, in one modified embodiment, the means for driving the folding cylinder 1 includes a toothed belt connecting two pinions, a first pinion keyed onto the journal 18 of the folding cylinder and a second pinion fixed to the framework 3', concentric to the journal 11 of the crankshaft 2, the second pinion having a number of meshing teeth double that of the first pinion.

In another modified embodiment, the cam 31 may also be rotatably driven by a toothed belt which connects two pinions comprising the same number of meshing teeth, one pinion being fixed to the cam 31 and the other pinion being fixed to the framework 3 concentric to the journal 10 of the crankshaft 2.

It is intended that the present invention not be limited to the specific embodiments disclosed herein. Rather, it is intended to cover all modifications and alternative constructions falling within the spirit and scope of the invention as expressed in the claims.

I claim:

1. A folding device for folding a copy along a line parallel to a direction of forward travel of the copy, the copy being delivered to a folding table having a longitudinal central slit, comprising:

a crankshaft, disposed below the folding table in line with the central slit, rotatably driven about a central axis of rotation parallel to the direction of forward travel of the copy; and a folding cylinder having a radius R and an external surface S, rotatably mounted about a central geometric axis on the crankshaft, the central geometric axis being parallel to the central axis of rotation of the crankshaft and offset with respect to the central axis of rotation by a distance equal to the radius R, so that each time a copy is folded, the crankshaft makes a complete revolution about the central axis of rotation simultaneously driving the folding cylinder through its own rotational movement about the central geometric axis, so that any point on the external surface S of the folding cylinder moves along a straight line of length equal to four times the radius R.

2. The folding device according to claim 1, further comprising a folding jaw mounted radially on the surface S of the folding cylinder and extending along a generatrix of the surface S.

3. The folding device according to claim 2, further comprising a folding blade disposed in line with the slit above the copy to be folded in a gripping position on the folding table, and extending in a horizontal direction parallel to the direction of forward travel of the copy, the blade oscillating vertically in synchronization with the rotational movements of the crankshaft and the folding cylinder, so that the blade engages in the folding jaw when the folding jaw is below the gripping position.

4. The folding device according to claim 2, further comprising a folding blade disposed in line with the slit above the copy to be folded in a gripping position on the folding table, and extending in a horizontal direction parallel to the direction of forward travel of the copy, the folding blade being fixed, so that upon each passage of the folding jaw in line with the slit, an active portion of the folding jaw projects through the slit and grips the copy to be folded.

5. The folding device according to claims 2, 3, or 4, further comprising a set of control elements mounted on the folding cylinder and connected to a member for transmitting the rotational movement of the crankshaft, the set of control elements controlling the opening and closing of the folding jaw.

6. The folding device according to claim 5, wherein the set of control elements comprise a shaft connected to the folding jaw, a lever connecting the shaft to a cam follower, and a cam mounted on the folding cylinder concentric to the central geometric axis, the cam being connected to the transmission member by means of a first drive member on which the cam follower bears.

7. The folding device according to claim 6, further comprising a set of drive means intended to drive the folding cylinder in its own rotational movement about the central geometric axis.

8. The folding device according to claim 7, wherein the set of drive means comprises a first drive means mounted on the folding cylinder opposite the cam concentric to the central geometric axis which interacts with a second intermediate drive means itself connected to a third drive means mounted on a framework fixed concentric to the central axis of rotation of the crankshaft, the third drive means comprising a number of teeth which is double the number of teeth of the first drive means.

9. The folding device according to claim 6, wherein the transmission member comprises an intermediate drive member interacting with a second drive member mounted on a framework fixed opposite the framework, concentric to the central axis of rotation of the crankshaft, the first and second drive members having the same number of teeth.

10. The folding device according to any one of the preceding claims, further comprising a receiving belt disposed below the crankshaft for receiving the folded copies.

* * * * *